US010465667B2

(12) United States Patent
Matsuo et al.

(10) Patent No.: US 10,465,667 B2
(45) Date of Patent: Nov. 5, 2019

(54) VARIABLE DISPLACEMENT PUMP

(71) Applicant: KABUSHIKI KAISHA TOYOTA JIDOSHOKKI, Kariya-shi, Aichi (JP)

(72) Inventors: Tsutomu Matsuo, Kariya (JP); Naoya Yokomachi, Kariya (JP); Yuki Ueda, Kariya (JP); Takashi Uno, Kariya (JP)

(73) Assignee: KABUSHIKI KAISHA TOYOTA JIDOSHOKKI, Kariya-shi, Aichi (JP)

( * ) Notice: Subject to any disclaimer, the term of this patent is extended or adjusted under 35 U.S.C. 154(b) by 24 days.

(21) Appl. No.: 15/768,125

(22) PCT Filed: Sep. 23, 2016

(86) PCT No.: PCT/JP2016/078103
§ 371 (c)(1),
(2) Date: Apr. 13, 2018

(87) PCT Pub. No.: WO2017/064993
PCT Pub. Date: Apr. 20, 2017

(65) Prior Publication Data

US 2018/0306171 A1 Oct. 25, 2018

(30) Foreign Application Priority Data

Oct. 15, 2015 (JP) ..... 2015-203491

(51) Int. Cl.
*F04B 1/32* (2006.01)
*F04B 1/20* (2006.01)
(Continued)

(52) U.S. Cl.
CPC ..... *F04B 1/324* (2013.01); *F04B 1/2064* (2013.01); *F04B 1/2078* (2013.01); *F04B 53/22* (2013.01); *F04B 53/168* (2013.01)

(58) Field of Classification Search
CPC ..... F03C 1/0636; F03C 1/0686; F04B 1/20; F04B 1/324; F04B 53/166; F04B 53/168; F01B 3/0032; F16J 10/04
See application file for complete search history.

(56) References Cited

U.S. PATENT DOCUMENTS 3,154,983 A 11/1964 Firth et al.
3,774,505 A * 11/1973 McLeod ..... F04B 1/20 91/506

(Continued)

FOREIGN PATENT DOCUMENTS

DE 90 10 372.6 U1 10/1990
JP 2002-202048 A 7/2002

(Continued)

OTHER PUBLICATIONS

Aluminum—Specifications, Properties, Classifications and Classes, May 17, 2005, https://www.azom.com/article.aspx?ArticleID=2863 (Year: 2005).*

(Continued)

*Primary Examiner* — F Daniel Lopez
*Assistant Examiner* — Metthew Wiblin
(74) *Attorney, Agent, or Firm* — Sughrue Mion, PLLC

(57) ABSTRACT

Provided is a variable displacement pump which includes a cylinder block including a plurality of cylinder bores formed in a rotation shaft in a circumferential direction and rotating together with the rotation shaft, a piston provided inside each of the plurality of cylinder bores to be slidable, and a swash plate supported to be tiltable with respect to the rotation shaft while a distal end portion of the piston is slidable thereon and which sucks and discharges a working fluid by moving the piston in a reciprocating manner with a stroke in accordance with an inclination angle of the swash plate, the variable displacement pump including: a control piston which includes a piston portion pressing the swash (Continued)

plate and controls the inclination angle of the swash plate; a piston accommodation portion which is formed in the housing and accommodates the piston portion; and a hollow cylindrical guide portion which is disposed between the piston accommodation portion and the piston portion and includes an inner peripheral surface supporting the piston portion to be slidable thereon, in which the housing is formed of a material having higher fatigue strength than the guide portion and the guide portion is formed of a material harder than the housing.

4 Claims, 3 Drawing Sheets

(51) Int. Cl.
*F04B 53/22* (2006.01)
*F04B 53/16* (2006.01)

(56) References Cited

U.S. PATENT DOCUMENTS 4,911,063 A * 3/1990 Kawahara ..... F04B 1/324 74/60
2009/0110575 A1* 4/2009 Munakata ..... B23K 11/16 417/437
2011/0113954 A1 5/2011 Mori et al.
2011/0154983 A1* 6/2011 Bischofberger ..... F02F 1/18 92/169.1
2013/0333555 A1* 12/2013 Xue ..... C22C 37/00 92/171.1
2018/0266407 A1* 9/2018 Hebrard ..... F16J 10/04

FOREIGN PATENT DOCUMENTS

JP 2012255375 A 12/2012
JP 2015117658 A 6/2015

OTHER PUBLICATIONS

Communication dated Aug. 20, 2018 from the European Patent Office in counterpart application No. 16855247.9.
International Preliminary Report on Patentability with a Translation of Written Opinion issued from the International Bureau in counterpart International Application No. PCT/JP2016/078103, dated Apr. 26, 2018.
International Search Report dated Dec. 27, 2016, issued by the International Searching Authority in International Application No. PCT/JP2016/078103.

* cited by examiner

VARIABLE DISPLACEMENT PUMP

CROSS REFERENCE TO RELATED APPLICATIONS

This application is a National Stage of International Application No. PCT/JP2016/078103 filed Sep. 23, 2016, claiming priority based on Japanese Patent Application No. 2015-203491 filed Oct. 15, 2015.

TECHNICAL FIELD

The present invention relates to a variable displacement pump.

BACKGROUND ART

Hitherto, there is known a variable displacement pump which changes a discharge amount of the pump by changing an inclination angle of a swash plate. For example, Patent Literature 1 discloses a variable displacement pump which sucks and discharges a working fluid by moving a piston inside a cylinder block rotating integrally with a rotation shaft in a reciprocating manner with a stroke in accordance with an inclination angle of a swash plate. The variable displacement pump disclosed in Patent Literature 1 includes a control piston which includes a piston portion pressing the swash plate and controls the inclination angle of the swash plate and a housing which includes a piston accommodation portion accommodating the piston portion. The piston portion presses the swash plate through, for example, a cylindrical roll or the like.

CITATION LIST

Patent Literature

Patent Literature 1: Japanese Unexamined Patent Publication No. 2015-117658

SUMMARY OF INVENTION

Technical Problem

In the variable displacement pump disclosed in Patent Literature 1, a displacement of a contact point between the roll or the like and the piston portion occurs in response to the inclination angle of the swash plate. Due to this displacement or the like, a force in which the axial direction of the piston portion is tilted from a direction along the axis center of the piston accommodation portion is applied to the piston portion. When the piston portion slides inside the piston accommodation portion while such a force is exhibited, the piston portion is easily caught by the piston accommodation portion and the wear of the piston accommodation portion easily occurs. In order to suppress the wear of the piston accommodation portion, a method of increasing the hardness of the housing constituting the piston accommodation portion is considered. However, when the hardness of the housing is increased, a problem arises in that the fatigue strength of the housing is easily deteriorated.

An object of the invention is to provide a variable displacement pump capable of suppressing deterioration in fatigue strength of a housing while suppressing the wear of a piston accommodation portion.

Solution to Problem

According to an aspect of the invention, there is provided a variable displacement pump which includes a rotation shaft rotatably supported by a housing, a cylinder block including a plurality of cylinder bores formed in the rotation shaft in a circumferential direction and rotating integrally with the rotation shaft, a piston provided inside each of the plurality of cylinder bores to be slidable, and a swash plate supported to be tiltable with respect to the rotation shaft while a distal end portion of the piston is slidable thereon and which sucks and discharges a working fluid by moving the piston in a reciprocating manner with a stroke in accordance with an inclination angle of the swash plate, the variable displacement pump including: a control piston which includes a piston portion pressing the swash plate and controls the inclination angle of the swash plate; a piston accommodation portion which is formed in the housing and accommodates the piston portion; and a hollow cylindrical guide portion which is disposed between the piston accommodation portion and the piston portion and includes an inner peripheral surface supporting the piston portion to be slidable thereon, in which the housing is formed of a material having higher fatigue strength than the guide portion and the guide portion is formed of a material harder than the housing.

In the variable displacement pump according to an aspect of the invention, the hollow cylindrical guide portion is disposed between the piston accommodation portion and the piston portion and the piston portion slides on the inner peripheral surface of the guide portion. Since the guide portion is formed of a material harder than the housing, the wear resistance is more excellent than the housing. Since the guide portion with excellent wear resistance is interposed between the piston accommodation portion and the piston portion, the piston accommodation portion is protected by the guide portion. Accordingly, it is possible to suppress the wear of the piston accommodation portion due to the sliding of the piston portion. Since the housing is formed of a material having higher fatigue strength than the guide portion, the fatigue strength is larger than that of at least the guide portion. With the above-described configuration, it is possible to suppress deterioration in fatigue strength of the housing while suppressing the wear of the piston accommodation portion.

In the variable displacement pump according to another aspect, an inner peripheral surface of the piston accommodation portion may be provided with a female threaded portion and an outer peripheral surface of the guide portion may be provided with a male threaded portion which is able to be threaded into the female threaded portion. In this case, since the female threaded portion formed in the inner peripheral surface of the piston accommodation portion and the male threaded portion formed in the outer peripheral surface of the guide portion are threaded into each other, the piston accommodation portion and the guide portion are assembled to each other. With such a simple assembling configuration, a space can be saved. Further, since the adhesion between the inner peripheral surface of the piston accommodation portion and the outer peripheral surface of the guide portion is improved when the female threaded portion and the male threaded portion are threaded into each other, it is possible to suppress the leakage of oil at the gap between the piston accommodation portion and the guide portion.

In the variable displacement pump according to another aspect, a fixed portion having an outer diameter larger than the inner diameter of the piston accommodation portion may be formed at the opening end portion on the side of the swash plate in the guide portion. In this case, since the fixed portion formed at the opening end portion on the side of the swash plate in the guide portion has an outer diameter larger than the inner diameter of the piston accommodation portion, the fixed portion is locked to the piston accommodation portion. Accordingly, the movement of the guide portion in the axial direction of the piston accommodation portion is regulated and the piston accommodation portion and the guide portion can be strongly fixed to each other.

In the variable displacement pump according to another aspect, a groove portion may be formed at the opening end portion on the side of the swash plate in the guide portion. In this case, a jig can engage with the groove portion formed at the opening end portion on the side of the swash plate in the guide portion. As a result, the guide portion can be easily assembled to the piston accommodation portion.

Advantageous Effects of Invention

According to the invention, it is possible to suppress deterioration in fatigue strength of the housing while suppressing the wear of the piston accommodation portion.

DESCRIPTION OF EMBODIMENTS

Figure 1:
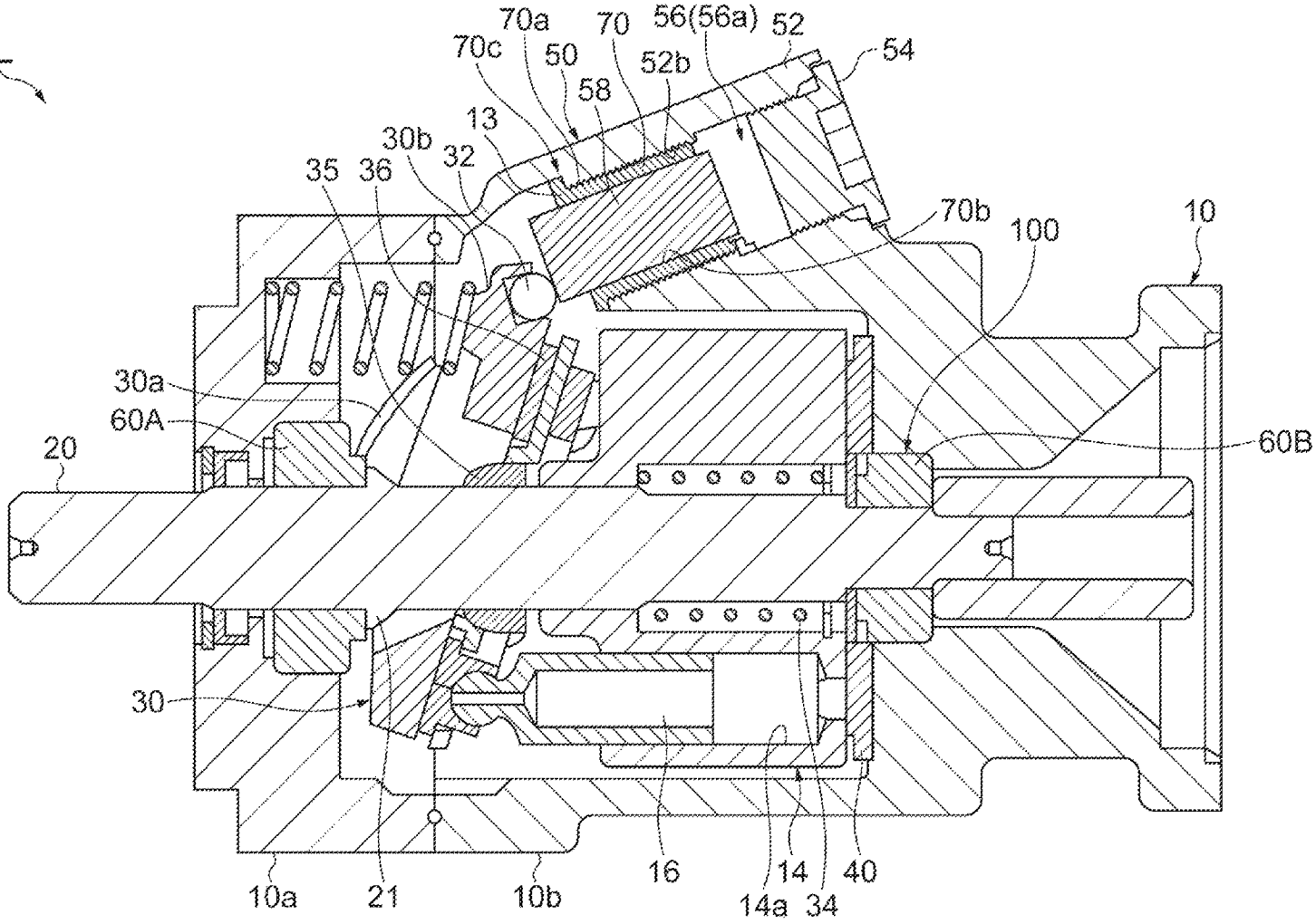
FIG. 1 is a schematic cross-sectional view illustrating a variable displacement pump according to an embodiment of the invention.

Hereinafter, embodiments of the invention will be described in detail with reference to the accompanying drawings. In the description, the same reference numerals will be used for the same components or components having the same function and a redundant description will be omitted.

First, a configuration of a variable displacement pump 1 according to the embodiment will be described. The variable displacement pump 1 will be described with reference to FIG. 1.

The variable displacement pump 1 includes a pump housing 10 (a housing), a rotation shaft 20 which is rotatably supported by the pump housing 10 and has an end portion protruding from the pump housing 10, a cylinder block 14 which has a plurality of cylinder bores 14*a* in the circumferential direction of the rotation shaft 20 and rotates integrally with the rotation shaft 20, a piston 16 which is provided to be slidable in each of the plurality of cylinder bores 14*a*, and a swash plate 30 which is supported to be tiltable with respect to the rotation shaft 20 while a distal end portion of the piston 16 is slidable thereon. In the variable displacement pump 1, the piston 16 performs a reciprocating stoke in response to the inclination angle of the swash plate 30 so that a working fluid is sucked and discharged.

The pump housing 10 includes a front housing 10*a* and a main housing 10*b* and both members are integrated with each other by screw members (not illustrated).

The rotation shaft 20 of which one end portion and the other end portion are rotatably supported by bearing portions 60A and 60B is attached to the pump housing 10. The rotation shaft 20 is connected to a power output device (not illustrated) such as an engine or a motor at the end portion protruding from the pump housing 10. In accordance with the driving of the power output device, the rotation shaft 20 rotates.

The cylinder block 14 which is rotatably spline-fitted to the rotation shaft 20 is accommodated in the pump housing 10. The cylinder block 14 is provided with the plurality of cylinder bores 14*a* disposed at a predetermined interval in the circumferential direction of the rotation shaft 20. Each piston 16 is slidably inserted into each cylinder bore 14*a*. A shoe is attached to a head portion which is one end portion (a left end portion of FIG. 1) of each piston 16. These shoes are collectively held by a retainer plate 36.

Further, the swash plate 30 is accommodated on the side of the front housing 10*a* inside the pump housing 10. The swash plate 30 is rotatably supported through a swash plate bearing 30*a* and can oscillate in the axial direction of the rotation shaft 20. When an urging force of a spring member 34 provided between the cylinder block 14 and the rotation shaft 20 is transmitted to the retainer plate 36 through a pivot 35, the retainer plate 36 is pressed against the swash plate 30. Further, each piston 16 slidably contacts the swash plate 30 through the shoe. Further, the cylinder block 14 is pressed against a valve plate 40 fastened to an inner end wall surface opposite to the front housing 10*a* in the main housing 10*b*.

Then, when the cylinder block 14 rotates integrally with the rotation shaft 20, each piston 16 moves in a reciprocating manner by a stroke specified by the inclination angle of the swash plate 30 and the cylinder bore 14*a* alternately communicates with an intake port (not illustrated) and a discharge port (not illustrated) formed in the valve plate 40 to have a circular-arc shape. Accordingly, the working oil is sucked from the intake port into the cylinder bore 14*a* and the working oil inside the cylinder bore 14*a* is discharged from the discharge port by a pumping action. In addition, an intake passage (not illustrated) and a discharge passage (not illustrated) are formed at the wall portion on the other end portion side of the main housing 10*b* and respectively communicate with the intake port and the discharge port.

The variable displacement pump 1 further includes a control piston 50. The control piston 50 includes a piston portion 58 which presses the swash plate 30 and controls the inclination angle of the swash plate 30. The piston portion 58 of the control piston 50 is accommodated in a piston accommodation portion 52 formed at the side portion of the main housing 10*b* of the pump housing 10.

The piston accommodation portion 52 extends in a direction inclined with respect to the rotation shaft 20 and has a substantially cylindrical shape extending toward an edge portion of the swash plate 30.

In the opening of the piston accommodation portion 52, an opening which is distant from the swash plate 30 is blocked by a screw 54. Accordingly, a piston accommodation room 56 is defined inside the piston accommodation portion 52. The piston portion 58 is accommodated in the piston accommodation room 56. In addition, in the piston accommodation room 56, a space between the piston portion 58 and the screw 54 serves as a control room 56*a* into which the working oil flows.

Figure 3:
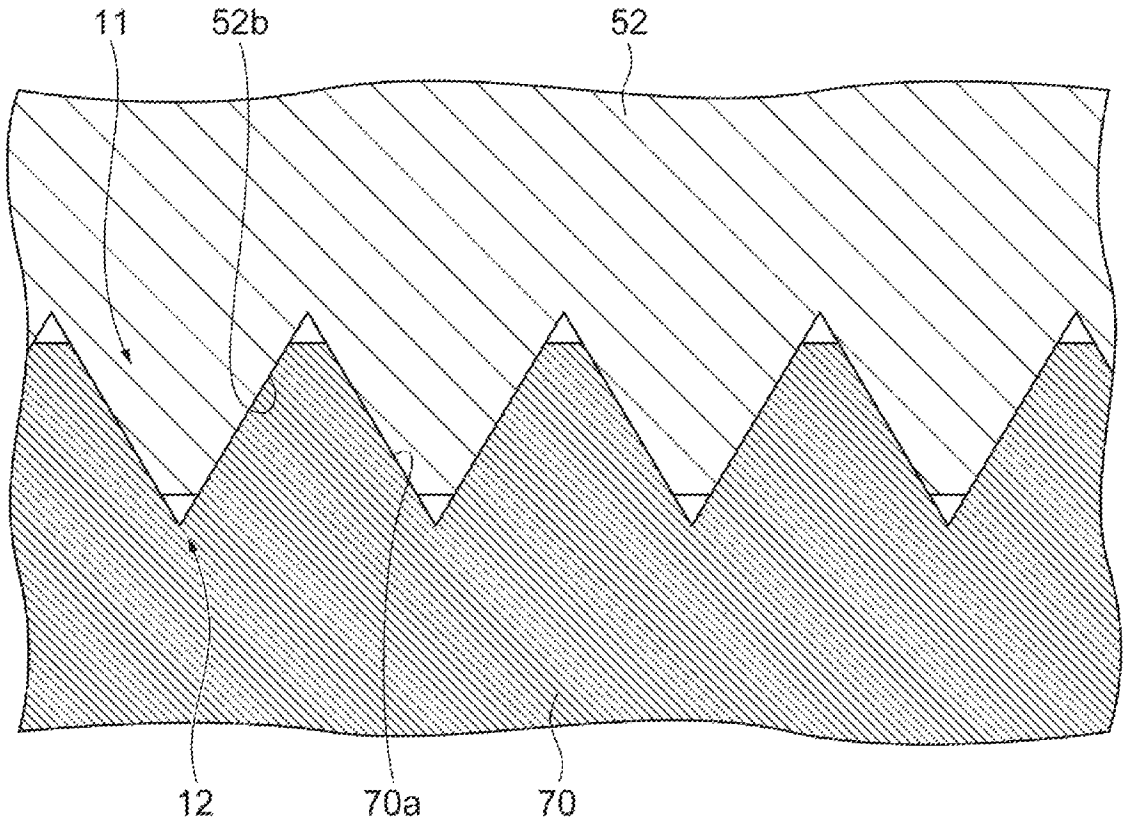
FIG. 3 is an enlarged view of an inner peripheral surface of a piston accommodation portion and an outer peripheral surface of a guide portion.

An inner peripheral surface 52*b* of the piston accommodation portion 52 is provided with a female threaded portion 11 (see FIG. 3). A hollow cylindrical guide portion 70 is disposed along the inner peripheral surface 52*b* of the piston accommodation portion 52. The guide portion 70 is disposed between the piston accommodation portion 52 and the piston portion 58. A flange-shaped fixed portion 13 is formed at an opening end portion 70*c* on the side of the swash plate 30 in the guide portion 70. An inner peripheral surface 70*b* of the guide portion 70 supports the piston portion 58 in a slidable manner. An outer peripheral surface 70*a* of the guide portion 70 is provided with a male threaded portion 12 which can be threaded into the female threaded portion 11 (see FIG. 3).

A state where the male threaded portion 12 and the female threaded portion 11 can be threaded into each other means a state where the threaded mountain portions of the male threaded portion 12 and the female threaded portion 11 can be fitted to each other. That is, a state where the male threaded portion 12 and the female threaded portion 11 can be threaded into each other means a state where the outer diameter of the male threaded portion 12 is substantially the same as the diameter of the threaded valley portion of the female threaded portion 11, the diameter of the threaded valley portion of the male threaded portion 12 is substantially the same as the inner diameter of the female threaded portion 11, and the angles and the pitches (a distance between the centers of the adjacent threaded mountain portions) of the threaded mountain portions are substantially the same in the male threaded portion 12 and the female threaded portion 11.

The piston portion 58 has a columnar shape in appearance. The diameter of the piston portion 58 is designed so that no gap is formed with respect to the inner peripheral surface 70*b* of the guide portion 70 disposed in the piston accommodation portion 52 and the piston portion 58 is slidable in the guide portion 70. The diameter of the piston portion 58 affects a decrease in volume and a returning speed and is appropriately adjusted according to the application. For this reason, the guide portion 70 having a different inner diameter may be used in response to the diameter of the piston portion 58.

The control piston 50 can move the piston portion 58 toward the swash plate 30 in a reciprocating manner by controlling the working oil toward the control room 56*a*. Then, when the piston portion 58 presses a roll 32 provided in an edge portion 30*b* of the swash plate 30, the inclination angle of the swash plate 30 is changed. As a result, the discharge capacity of the variable displacement pump 1 is changed.

Next, a shape of the guide portion 70 will be described in detail with reference to FIGS. 2 and 3. FIG. 2 is an end surface diagram and a side view of the guide portion 70 illustrated in FIG. 1. FIG. 2(*a*) is an end surface diagram of the guide portion 70 and FIG. 2(*b*) is a side view of the guide portion 70. FIG. 3 is an enlarged view of the inner peripheral surface 52*b* of the piston accommodation portion 52 and the outer peripheral surface 70*a* of the guide portion 70. Additionally, in FIG. 2, the male threaded portion 12 which is formed in the outer peripheral surface 70*a* of the guide portion 70 is not illustrated in the drawings.

As illustrated in FIGS. 2(*a*) and 2(*b*), the guide portion 70 has a hollow cylindrical shape of which one end and the other end are opened. The fixed portion 13 which is formed on the side of the opening end portion 70*c* of the guide portion 70 has an annular shape. The fixed portion 13 protrudes outward in a flange shape from the outer peripheral surface 70*a* of the guide portion 70. That is, the fixed portion 13 has an outer diameter larger than the inner diameter of the piston accommodation portion 52.

Figure 2:
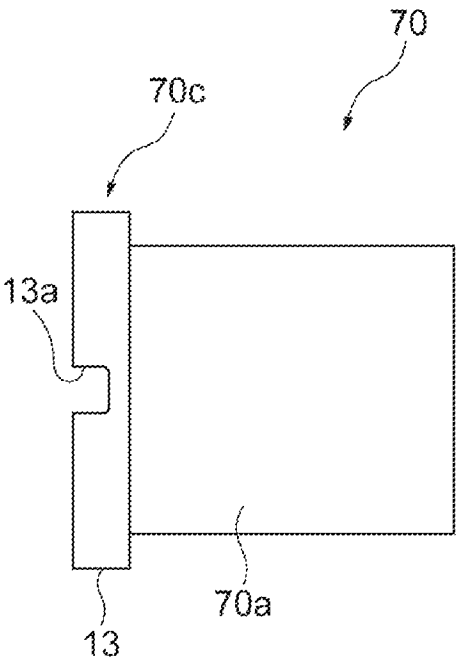
FIG. 2(*a*) is an end surface diagram of a guide portion illustrated in FIG. 1 and FIG. 2(*b*) is a side view of the guide portion.
Figure 2:
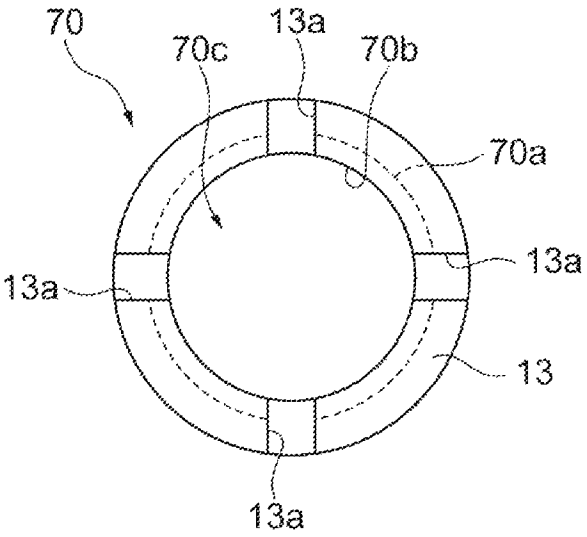

The fixed portion 13 is locked to an end portion on the side of the swash plate 30 in the piston accommodation portion 52 (see FIG. 1). Accordingly, the movement of the guide portion 70 in the axial direction of the piston accommodation portion 52 is regulated. Further, the fixed portion 13 has a function of sealing a gap between the guide portion 70 and the piston accommodation portion 52. Additionally, a gap between the guide portion 70 and the piston accommodation portion 52 may be sealed by using an O-ring and a packing along with the fixed portion 13 or instead of the fixed portion 13.

The fixed portion 13 is provided with a plurality of (in the embodiment, four) groove portions 13*a*. That is, four groove portions 13*a* are formed at the opening end portion 70*c* of the guide portion 70. Four groove portions 13*a* are arranged at the same interval on the circumference. Four groove portions 13*a* are respectively notched in a substantially rectangular shape. A jig for assembling the guide portion 70 into the piston accommodation portion 52 can engage with four groove portions 13*a*. The jig is, for example, a member having a cross-shaped protrusion portion engaging with four groove portions 13*a*. A worker which performs the assembling operation, or the like engages the jig with four groove portions 13*a* and turns the jig so that the guide portion 70 is screwed into the piston accommodation portion 52. At this time, the guide portion 70 is screwed into the piston accommodation portion 52 until the fixed portion 13 is locked to the end portion on the side of the swash plate 30 in the piston accommodation portion 52. Accordingly, the guide portion 70 is assembled to the piston accommodation portion 52.

As illustrated in FIG. 3, the threaded mountain portions of the female threaded portion 11 are formed in parallel to the axis center of the guide portion 70 to have the same diameter in the outer peripheral surface 70*a* of the substantially cylindrical guide portion 70. The threaded mountain portions of the male threaded portion 12 are formed in parallel to the axis center of the piston accommodation portion 52 to have the same diameter in the inner peripheral surface 52*b* of the substantially cylindrical piston accommodation portion 52. That is, the female threaded portion 11 and the male threaded portion 12 are so-called pipe parallel threads. The threaded mountain portion of the female threaded portion 11 and the threaded mountain portion of the male threaded portion 12 have a substantially triangular shape.

The female threaded portion 11 and the male threaded portion 12 are threaded into each other and the inner peripheral surface 52*b* of the piston accommodation portion 52 and the outer peripheral surface 70*a* of the guide portion 70 are fitted to each other. A surface of the threaded valley portion of the female threaded portion 11 and a surface of the threaded mountain portion of the male threaded portion 12 support each other and a surface pressure is formed between the inner peripheral surface 52*b* and the outer peripheral surface 70*a*. Accordingly, since the adhesion between the piston accommodation portion 52 and the guide portion 70 is improved, the working oil does not flow into a gap between the piston accommodation portion 52 and the guide portion 70.

In the embodiment, the guide portion 70 is formed of a material which is harder than the pump housing 10. Generally, in the case of metal or the like, the metal is less prone to wear as a difference in hardness from the material of the counter sliding member becomes smaller. In order to prevent deformation and wear, the piston portion 58 is formed of, for example, a high-rigid material such as chromium molybdenum steel. Thus, the guide portion 70 is formed of a high-rigid material which withstands wear due to the sliding of the piston portion 58 rather than the pump housing 10. As the high-rigid material, for example, an FC material (gray cast iron) or a quenched product of carbon steel is exemplified. Since the guide portion 70 is formed of a material harder than the pump housing 10, a difference in hardness with the piston portion 58 is small compared to the pump housing 10. As a result, the wear resistance is better than that of the pump housing 10.

On the contrary, the pump housing 10 is formed of a material having higher fatigue strength than the guide portion 70. Here, the fatigue strength is the upper limit of the stress amplitude that does not break even when stress is applied an infinite number of times when repeated stress is applied to the material. That is, the fatigue strength herein is an index (so-called fatigue strength) indicating a certain force which does not break a member when a constant force is repeatedly applied to the member an infinite number of times. Thus, the pump housing 10 is formed of a material having higher fatigue strength than the guide portion 70. As a material having high fatigue strength, for example, an FCD material (ductile cast iron), a CV material, or the like is exemplified.

In the embodiment, the guide portion 70 is formed of an FC material (gray cast iron) and the pump housing 10 is formed of an FCD material (ductile cast iron). Since the FC material and the FCD material are a type of cast iron and cast iron generally includes a lot of carbon, graphite precipitates in the structure. The FCD material and the FC material are different in their properties because the shape of the deposited graphite is different. Since the shape of the graphite to be precipitated is flaky, the FC material is less sticky than steel and hard. Furthermore, the FC material is also excellent in machinability and workability. On the contrary, the FCD material has toughness close to that of steel since the shape of the graphite to be precipitated is spherical.

As described above, according to the variable displacement pump 1 of the embodiment, the hollow cylindrical guide portion 70 is disposed between the piston accommodation portion 52 and the piston portion 58 and the piston portion 58 slides on the inner peripheral surface 70*b* of the guide portion 70. Since the guide portion 70 is formed of a material harder than the pump housing 10, the wear resistance is more excellent than the pump housing 10. Since the guide portion 70 having excellent wear resistance is interposed between the piston accommodation portion 52 and the piston portion 58, the piston accommodation portion 52 is protected by the guide portion 70. Accordingly, it is possible to suppress the wear of the piston accommodation portion 52 due to the sliding of the piston portion 58. Since the pump housing 10 is formed of a material having higher fatigue strength than that of the guide portion 70, the fatigue strength is higher than at least that of the guide portion 70. As described above, it is possible to suppress deterioration in fatigue strength of the pump housing 10 while suppressing the wear of the piston accommodation portion 52.

According to the variable displacement pump 1 of the embodiment, since the female threaded portion 11 formed in the inner peripheral surface 52*b* of the piston accommodation portion 52 and the male threaded portion 12 formed in the outer peripheral surface 70*a* of the guide portion 70 are threaded into each other, the piston accommodation portion 52 and the guide portion 70 are assembled to each other. With the simple and easy assembling configuration, the space can be saved. Further, since the adhesion between the inner peripheral surface 52*b* of the piston accommodation portion 52 and the outer peripheral surface 70*a* of the guide portion 70 is improved due to the threading between the female threaded portion 11 and the male threaded portion 12, it is possible to suppress the leakage of the working oil in the gap between the piston accommodation portion 52 and the guide portion 70.

According to the variable displacement pump 1 of the embodiment, since the fixed portion 13 formed at the opening end portion 70*c* on the side of the swash plate in the guide portion 70 has an outer diameter larger than the inner diameter of the piston accommodation portion 52, the fixed portion 13 is locked to the piston accommodation portion 52. Accordingly, the movement of the guide portion 70 in the axial direction of the piston accommodation portion 52 is regulated and the piston accommodation portion 52 and the guide portion 70 can be strongly fixed.

According to the variable displacement pump 1 of the embodiment, a jig can engage with the groove portion 13*a* formed at the opening end portion 70*c* on the side of the swash plate of the guide portion 70. As a result, the guide portion 70 can be easily assembled to the piston accommodation portion 52.

According to the variable displacement pump 1 of the embodiment, since the guide portion 70 having a different inner diameter is used in response to the diameter of the piston portion 58, it is possible to constitute a variable displacement pump having plural kinds of operations and having different responsiveness with one kind of pump housing 10.

Although the embodiment of the invention has been described above, the invention is not limited to the above-described embodiment. For example, the invention may be modified within the scope not changing the gist described in each claim or may be applied to other applications.

The shapes of the female threaded portion 11 and the male threaded portion 12 are not limited to the above-described embodiment. For example, the female threaded portion 11 and the male threaded portion 12 may have a trapezoidal shape, a rectangular shape, a circular shape, or the like. Further, the female threaded portion 11 and the male threaded portion 12 may have a so-called pipe tapered thread shape by cutting a thread diameter to be tapered.

A shape of the groove portion 13*a* formed at the opening end portion 70*c* on the side of the swash plate 30 in the guide portion 70 is not limited to the above-described embodiment. For example, the shape may be various shapes in response to the jig used for the assembling operation and may not be a shape corresponding to the jig.

The inner peripheral surface 52*b* of the piston accommodation portion 52 may not be provided with the female threaded portion 11 and the outer peripheral surface 70*a* of the guide portion 70 may not be provided with the male threaded portion 12. In this case, for example, the guide portion 70 may be fixed to the piston accommodation portion 52 by a bolt or the like and the guide portion 70 may be fixed to the piston accommodation portion 52 by press-inserting or the like. Further, the opening end portion 70*c* on the side of the swash plate 30 in the guide portion 70 may not be provided with the fixed portion 13 and may not be provided with the groove portion 13*a*.

The piston accommodation portion 52 may not extend in a direction inclined with respect to the rotation shaft 20. That is, the piston accommodation portion 52 may extend in, for example, a direction parallel to the axial direction of the rotation shaft 20.

REFERENCE SIGNS LIST

1: variable displacement pump, 10: pump housing (housing), 11: female threaded portion, 12: male threaded portion, 13: fixed portion, 13*a*: groove portion, 14: cylinder block, 16: piston, 20: rotation shaft, 30: swash plate, 50: control piston, 52: piston accommodation portion, 52*b*: inner peripheral surface, 58: piston portion, 70: guide portion, 70*a*: outer peripheral surface, 70*b*: inner peripheral surface, 70*c*: opening end portion.

The invention claimed is:

1. A variable displacement pump which includes a rotation shaft rotatably supported by a housing, a cylinder block including a plurality of cylinder bores formed in the cylinder block in a circumferential direction and rotating integrally with the rotation shaft, a piston provided inside each of the plurality of cylinder bores to be slidable, and a swash plate supported to be tiltable with respect to the rotation shaft while a distal end portion of the piston is slidable thereon and which sucks and discharges a working fluid by moving the piston in a reciprocating manner with a stroke in accordance with an inclination angle of the swash plate, the variable displacement pump comprising:

a control piston which includes a piston portion pressing the swash plate and controls the inclination angle of the swash plate;

a piston accommodation portion which is formed in the housing and accommodates the piston portion; and a hollow cylindrical guide portion which is disposed between the piston accommodation portion and the piston portion and includes an inner peripheral surface supporting the piston portion to be slidable thereon, wherein the housing is formed of a material having higher fatigue strength than the guide portion and the guide portion is formed of a material harder than the housing.

2. The variable displacement pump according to claim 1, wherein an inner peripheral surface of the piston accommodation portion is provided with a female threaded portion, and an outer peripheral surface of the guide portion is provided with a male threaded portion which is able to be threaded into the female threaded portion.

3. The variable displacement pump according to claim 1, wherein a fixed portion having an outer diameter larger than an inner diameter of the piston accommodation portion is formed at an opening end portion on the side of the swash plate in the guide portion.

4. The variable displacement pump according to claim 1, wherein a groove portion is formed at an opening end portion on the side of the swash plate in the guide portion.

* * * * *